US006488016B2

(12) United States Patent
Kavonius

(10) Patent No.: US 6,488,016 B2
(45) Date of Patent: Dec. 3, 2002

(54) COMBUSTION ENHANCER

(76) Inventor: Eino John Kavonius, 516 Meadow La., Woodbury, MN (US) 55125-1122

( * ) Notice: Subject to any disclaimer, the term of this patent is extended or adjusted under 35 U.S.C. 154(b) by 0 days.

(21) Appl. No.: 09/827,554

(22) Filed: Apr. 6, 2001

(65) Prior Publication Data

US 2001/0035170 A1 Nov. 1, 2001

Related U.S. Application Data

(60) Provisional application No. 60/195,705, filed on Apr. 7, 2000.

(51) Int. Cl.[7] ..... F02M 33/00
(52) U.S. Cl. ..... 123/538
(58) Field of Search ..... 123/538, 536, 123/537

(56) References Cited

U.S. PATENT DOCUMENTS 4,429,665 A * 2/1984 Brown ..... 123/538
4,930,483 A * 6/1990 Jones ..... 123/538
5,044,347 A * 9/1991 Ullrich et al. ..... 123/538
5,048,499 A * 9/1991 Daywalt ..... 123/538
5,059,217 A * 10/1991 Arroyo et al. ..... 123/538
5,307,779 A * 5/1994 Wood et al. ..... 123/538
5,451,273 A * 9/1995 Howard et al. ..... 123/538
6,032,655 A * 3/2000 Kavonius ..... 123/538
6,205,984 B1 * 3/2001 Renard ..... 123/538

* cited by examiner

*Primary Examiner*—Marguerite McMahon
(74) *Attorney, Agent, or Firm*—Gerald E. Helget; Nelson R. Capes; Briggs and Morgan

(57) ABSTRACT

A combustion enhancer for insertion into the fuel line of a vehicle, consisting of a silver rod, with a cross-shaped cross section that is twisted axially to form a spiral. This form makes maximum contact with the fuel to swirl the fuel along the surfaces of the silver rod. The surfaces of the silver rod are roughened to promote additional turbulence. The fuel flowing over the silver helix creates a charge of static electricity and changes the fuel molecules to a more uniform size.

8 Claims, 1 Drawing Sheet

COMBUSTION ENHANCER

This application claims benefit of provisional application 60/195,705 filed Apr. 7, 2000.

BACKGROUND OF THE INVENTION

1. Field of the Invention

The invention applies to the field of devices that are placed in the fuel line of a vehicle to enhance the combustion in an internal combustion engine.

2. Description of the Prior Art

In a typical automobile engine, only about 65 percent of the fuel is burned in the engine. The rest is emitted into the air via the tail pipe in the form of hydrocarbons or carbon monoxide. The catalytic converter is added to convert these unburned fuels to carbon dioxide and water, but the process is not 100 percent efficient. This incomplete combustion wastes fuel and contributes to air pollution. Various prior devices have been tried in order to increase combustion efficiency. Most of these devices have not performed well.

The twin problems of fossil fuel shortage and environmental damage due to the combustion of fossil fuels has created an increasing demand for higher efficiency internal combustion engines for motor vehicles. The higher efficiency engine would require less fuel to operate because it would obtain increased energy conversion efficiency from an identical amount of fuel used for a low efficiency engine. Consequently, less unburned fuel in the form of hydrocarbons enters the atmosphere along with the other exhaust gases, typically CO, CO2 and NO2. The level of environmental pollution in the form of photochemical smog would consequently be reduced since such smog is caused by ultraviolet radiation of unburned hydrocarbons in the atmosphere.

There have been prior art devices commercially available which have been directed to improving combustion efficiency. However, most of the prior art devices require modification to the carburetor, fuel injection or induction system of the internal combustion engine. These modifications may void the manufacturer's warranty, especially as directed to emission control devices, and may further be non-certifiable or unlawful under various state and federal emission control or atmospheric quality regulations. Therefore, it would be advantageous for motor vehicle owners to simply attach an inexpensive fuel conditioning apparatus to the fuel lines of their automobile engines which would improve the fuel efficiency of the engine without voiding the warranty or operating unlawful equipment.

Gasoline is made up of hydrogen and carbon atoms combined into various kinds of molecules called hydrocarbons. The liquid hydrocarbons commonly used to produce gasoline have from 4 to 12 carbon atoms in each molecule and vaporize, or boil, at temperatures from approximately 100° F. (37.78° C.) to 400° F. (204.44° C.). Each one of these molecules has different qualities and characteristics with regard to the speed and temperature at which it will ignite and burn in a cylinder of an internal combustion engine.

It is generally known that the lighter components of gasoline ignite more readily than the heavier components. An example of an apparatus proposed to take advantage of the lighter components during start up of an internal combustion engine can be found in U.S. Pat. No. 3,783,841, issued Jan. 8, 1974, to D. A. Hirschler, Jr., et al., which derives more volatile hydrocarbons from normal gasoline for use during start up of an internal combustion engine by vaporizing and subsequently reliquidifying the fuel.

In the past, permanent magnets have been attached to fuel lines on internal combustion engines to increase the fuel economy of these engines. The specific mechanism of how the magnets increase the fuel economy is not fully understood. It is believed that the magnetic field partially ionizes the fuel flowing in the fuel line to increase its affinity for oxygen, thus, producing more complete combustion of the fuel in the cylinders of the engine.

Fuel conditioning devices operating on the above principles are disclosed in U.S. Pat. Nos. 4,036,182; 5,048,498; 5,271,369; and 6,041,763.

There is a need for an efficient, inexpensive fuel line conditioning device that can be inserted in the fuel line without the need for external magnets.

SUMMARY OF THE INVENTION

The invention is a combustion enhancer consisting of a silver rod, with a cross-shaped cross section that is twisted axially to form a spiral. This form makes maximum contact with the fuel to swirl the fuel along the surfaces of the silver rod. The surfaces of the silver rod are roughened to promote additional turbulence. The fuel flowing over the silver helix creates a charge of static electricity and changes the fuel molecules to a more uniform size.

A principal object and advantage of the invention is that the fuel is more completely burned, thus increasing the vehicle's average miles per gallon significantly. More efficient and complete combustion also makes more energy available to the engine, and provides increased power to the vehicle.

A second principle object and advantage of the invention is that it greatly reduces or eliminates emissions of hydrocarbons and carbon monoxide.

Another principle object and advantage of the invention is that the more complete combustion prevents formation and deposits of carbon in the engine, thus prolonging engine life.

DETAILED DESCRIPTION OF THE PREFERRED EMBODIMENT

Figure 1:
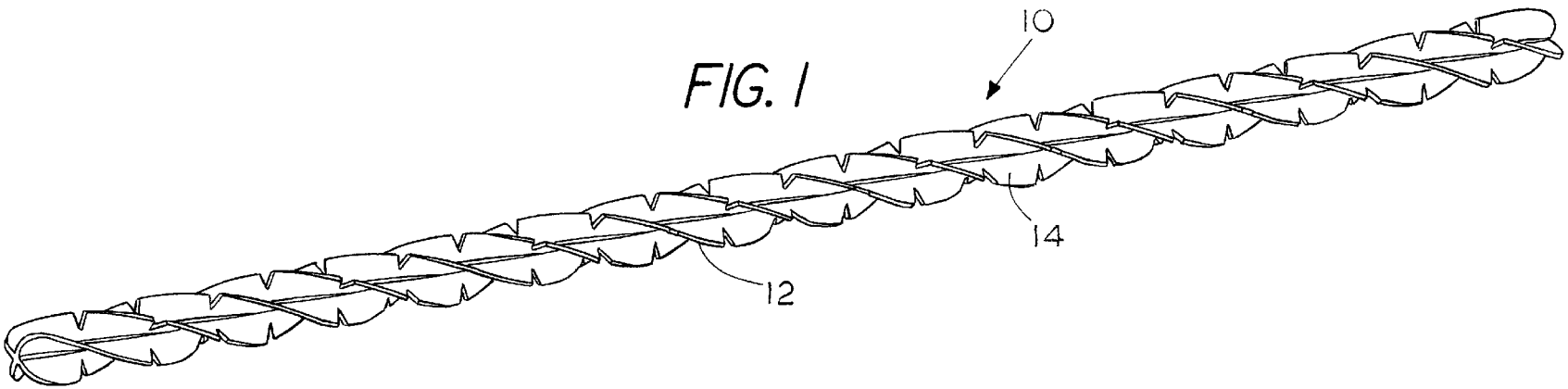
FIG. 1 is a perspective view of the device of the present invention.

The combustion enhancer of the present invention is generally designated in the Figures as reference numeral 10.

The combustion enhancer 10 is a cross-shaped helix 12 composed of metal.

The combustion enhancer 10 is made of a metal which conducts electricity. Silver is the preferred metal, since it is the best conductor of electricity and also resists oxidation and does not corrode. Copper is a possible alternative, as it conducts electricity well, but not as well as silver. The silver will preferably be alloyed with, or partially plated with, platinum since platinum acts as a catalyst in the fuel line.

The combustion enhancer 10 is usually one-fourth to three-eighths of an inch in diameter for use in automobiles. Versions may be used in tractors and in stationary engines. The length of the combustion enhancer may vary from six inches to twenty-four inches.

Figure 2:
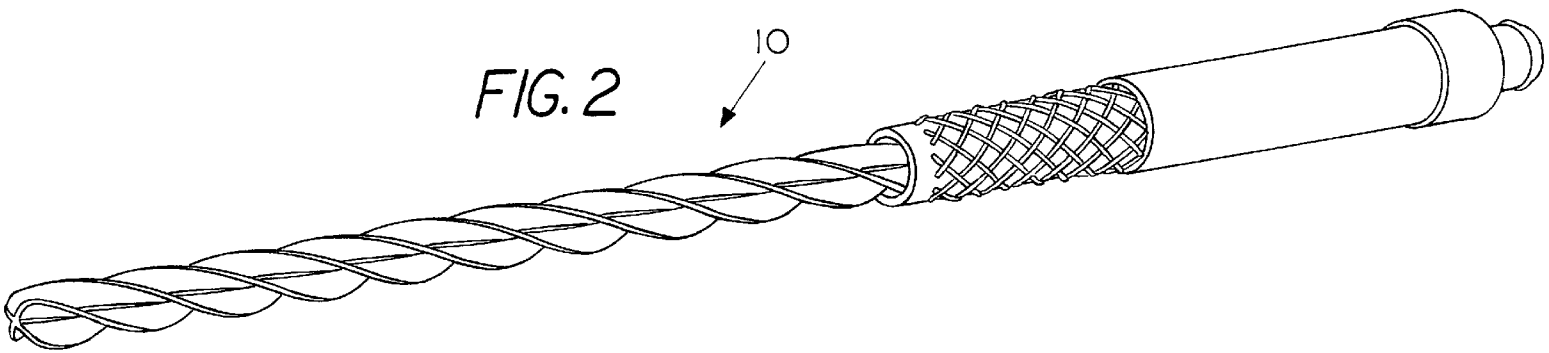
FIG. 2 is a perspective view of the device of the present invention inserted in a fuel line.

The combustion enhancer 10 is installed in the fuel line of an engine, specifically, in the fuel line in front of the fuel injector. It can be installed easily without modifying any original equipment, as shown in FIG. 2.

The passage of fuel through the combustion enhancer 10 conditions the fuel for efficient combustion by creating a charge and a change in molecular size.

The fuel flows along the helix 12 and is swirled, creating turbulence in the fuel. The silver helix, which has a large surface area, conducts electricity, creating a charge in the fuel for efficient combustion. The fuel molecules become smaller as the fuel is charged and swirled. The helix 12 may preferably have a roughened surface 14 that promotes additional turbulence.

Testing results over 10,000 miles indicated 20 to 30 percent reduction in fuel consumption, increased power, and reduced emissions to near zero. All tests indicated over 20 percent reduction in fuel consumption.

The present invention may be embodied in other specific forms without departing from the spirit or essential attributes thereof, and it is therefore desired that the present embodiment be considered in all respects as illustrative and not restrictive.

What is claimed:

1. Apparatus for enhancing combustion in an internal combustion engine for insertion into the engine's fuel line, comprising an elongate member constructed of an electrically-conductive metal, wherein the metal is silver, further comprising platinum plating on the silver.

2. The apparatus of claim 1, wherein the elongate member further comprises a helix.

3. The apparatus of claim 2, wherein the helix has a cross-shaped cross section.

4. The apparatus of claim 2, wherein the surface of the helix is roughened to promote turbulence in the fuel.

5. Apparatus for enhancing combustion in an internal combustion engine for insertion into the engine's fuel line, comprising an elongate member constructed of an electrically-conductive metal, wherein the elongate member further comprises a helix, wherein the metal is silver, further comprising platinum plating on the silver.

6. The apparatus of claim 5, wherein the helix has a cross-shaped cross section.

7. The apparatus of claim 6, wherein the surface of the helix is roughened to promote turbulence in the fuel.

8. Apparatus for enhancing combustion in an internal combustion engine for insertion into the engine's fuel line, comprising an elongate member constructed of an electrically-conductive metal, wherein the elongate member further comprises a helix with a cross-shaped cross section and a roughened surface, wherein the metal is silver, further comprising platinum plating on the silver.

* * * * *